US009144703B2

(12) United States Patent
Dalebout et al.

(10) Patent No.: US 9,144,703 B2
(45) Date of Patent: Sep. 29, 2015

(54) WEIGHT SELECTOR ASSEMBLIES, EXERCISE MACHINES INCLUDING SUCH WEIGHT SELECTOR ASSEMBLIES, AND RELATED METHODS

(71) Applicant: ICON Health & Fitness, Inc., Logan, UT (US)

(72) Inventors: William T. Dalebout, North Logan, UT (US); Paul C. Ricks, Petersboro, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 110 days.

(21) Appl. No.: 14/048,019

(22) Filed: Oct. 7, 2013

(65) Prior Publication Data

US 2014/0135185 A1 May 15, 2014

Related U.S. Application Data

(60) Provisional application No. 61/710,567, filed on Oct. 5, 2012.

(51) Int. Cl.
*A63B 21/062* (2006.01)
*A63B 23/04* (2006.01)

(52) U.S. Cl.
CPC ..... *A63B 21/062* (2013.01); *A63B 23/0494* (2013.01); *A63B 2021/0623* (2013.01); *A63B 2208/0261* (2013.01)

(58) Field of Classification Search
CPC ..... A63B 21/06; A63B 21/062; A63B 2021/0623
See application file for complete search history.

(56) References Cited

U.S. PATENT DOCUMENTS

| | | | | |
|---|---|---|---|---|
| 5,123,885 | A | 6/1992 | Shields | |
| 5,306,221 | A * | 4/1994 | Itaru | 482/98 |
| 6,117,049 | A | 9/2000 | Lowe | |
| 7,179,208 | B1 | 2/2007 | Nalley | |
| 7,473,211 | B2 | 1/2009 | Lee | |
| 7,507,189 | B2 | 3/2009 | Krull | |
| 7,608,021 | B1 | 10/2009 | Nalley | |
| 7,946,968 | B2 | 5/2011 | Kjellberg | |
| 8,047,970 | B2 | 11/2011 | Nalley | |
| 2002/0025888 | A1 | 2/2002 | Germanton et al. | |
| 2007/0004569 | A1 | 1/2007 | Cao | |
| 2008/0015094 | A1 * | 1/2008 | Casagrande | 482/100 |
| 2008/0188362 | A1 * | 8/2008 | Chen | 482/107 |
| 2009/0048079 | A1 | 2/2009 | Nalley | |
| 2009/0163334 | A1 * | 6/2009 | Gibson et al. | 482/101 |
| 2010/0285933 | A1 | 11/2010 | Nalley | |

* cited by examiner

*Primary Examiner* — Oren Ginsberg
(74) *Attorney, Agent, or Firm* — Holland & Hart LLP

(57) ABSTRACT

An exercise machine may comprise a plurality of weights arranged in a stack, a stem, and a plurality of weight selector switches mounted to the stem. Each weight selector switch of the plurality of weight selector switches may be positioned and configured to selectively couple a corresponding weight of the plurality of weights to the stem. A method of manufacturing a weight selecting device may comprise providing a stem, and mounting a plurality of weight selector switches to the stem.

17 Claims, 11 Drawing Sheets

WEIGHT SELECTOR ASSEMBLIES, EXERCISE MACHINES INCLUDING SUCH WEIGHT SELECTOR ASSEMBLIES, AND RELATED METHODS

CROSS-REFERENCE TO RELATED APPLICATIONS

This application claims priority to U.S. Provisional Patent Application No. 61/710,567 filed on Oct. 6, 2012.

TECHNICAL FIELD

The present disclosure relates to exercise equipment including a weight stack wherein a user may select a desired amount of weight for an exercise. More specifically, the present disclosure relates to weight selector assemblies, exercise machines including such weight selector assemblies, and related methods.

BACKGROUND

Exercise machines including a weight stack wherein an amount of weight applied to an attached cable may be selected by a user have been very popular. Such exercise machines may provide various selectable amounts of resistance, and thus may accommodate various exercises and various users with a single machine. There have been shortcomings, however, with conventional exercise machines that include a weight stack.

One problem with conventional exercise machines that include a weight stack lies in the way that weight is selected. Typically, a stem includes a plurality of apertures, each aperture corresponding to an aperture through a respective weight plate. To select a desired weight, a pin is inserted through an aperture of a weight plate and a corresponding aperture in the stem, thus coupling the weight plate to the stem. These pins may become misplaced, which may render the machine unusable. Additionally, misplaced, damaged, or stolen pins may be replaced with a pin that is of insufficient strength or size.

Another difficulty is that the insertion and/or removal of a weight selector pin may be difficult for some users. For example, the apertures in the stem and weights may become misaligned, making it difficult to insert and/or remove the weight selector pin.

U.S. Pat. No. 8,047,970 to Nalley teaches a weight plate with a detachable locking cartridge. Each weight plate in a weight stack may include such a detachable locking cartridge that includes a toggle switch that controls the displacement of a locking pin. Accordingly, a toggle switch may be rotated to position a pin into an aperture of a lifting pin. The locking cartridge of Nalley, however, has many shortcomings. For example, the locking cartridge is attached to the face of each weight. Since the pin, toggle switch, and associated linkages occupy significant space, the locking cartridges extend, cantilevered, a significant distance from the face of each weight. Accordingly, the locking cartridges may be susceptible to damage. Furthermore, each of the detachable locking cartridges and pins are separate from the lifting pin, being mounted to the weights, and do not provide weight selecting features that remain coupled to the lifting pin.

In view of the foregoing, improved devices and methods for weight selection would be desirable.

SUMMARY

According to one aspect of the disclosure, an exercise machine may comprise a plurality of weights arranged in a stack, a stem, and a plurality of weight selector switches mounted to the stem.

In an additional aspect, which may be combined with any other aspect herein, each weight selector switch of the plurality of weight selector switches may be positioned and configured to selectively couple a corresponding weight of the plurality of weights to the stem.

In an additional aspect, which may be combined with any other aspect herein, each weight selector switch of the plurality of weight selector switches may be rotatable relative to the stem.

In an additional aspect, which may be combined with any other aspect herein, each weight selector switch of the plurality of weight selector switches may comprise at least one lug positioned and configured to selectively enter a corresponding channel in a corresponding weight of the plurality of weights.

In an additional aspect, which may be combined with any other aspect herein, each weight selector switch of the plurality of weight selector switches may comprise two laterally extending lugs, each laterally extending lug configured to selectively enter a corresponding channel in a corresponding weight of the plurality of weights upon rotation relative to the stem.

In an additional aspect, which may be combined with any other aspect herein, each weight selector switch of the plurality of weight selector switches may comprise a respective detent mechanism.

In an additional aspect, which may be combined with any other aspect herein, each of the respective detent mechanisms may comprise a respective spring biased ball located within the stem.

In an additional aspect, which may be combined with any other aspect herein, each of the respective detent mechanisms may comprise a spring biased ball located within a respective weight selector switch.

In an additional aspect, which may be combined with any other aspect herein, the stem may comprise a plurality of channels and a portion of each weight selector switch of the plurality of weight selector switches may be positioned within a respective channel of the plurality of channels to couple each weight selector switch of the plurality of weight selector switches to the stem.

In an additional aspect, which may be combined with any other aspect herein, each weight of the plurality of weights may comprise at least one opening positioned to facilitate the passage of a respective lug of each weight selector switch of the plurality of weight selector switches therethrough as the stem is moved relative to the plurality of weights, and when the respective selector switch of the plurality of weight selector switches is positioned in a first position.

In an additional aspect, which may be combined with any other aspect herein, each weight of the plurality of weights may comprise a channel extending from each at least one opening, the channel positioned to receive a respective lug of each weight selector switch of the plurality of weight selector switches therein and facilitate mechanical interference between the respective lug and the weight causing the weight to move with the stem when the stem is moved, and when the respective selector switch of the plurality of weight selector switches is positioned in a second position.

In an additional aspect, which may be combined with any other aspect herein, the stem may be coupled to at least one cable.

In an additional aspect, which may be combined with any other aspect herein, each weight selector switch of the plurality of weight selector switches may comprise a sleeve positioned on the stem, a switch body positioned on the sleeve, and a cap positioned on the switch body.

In an additional aspect, which may be combined with any other aspect herein, the sleeve may comprise at least two detents and a spring biased ball may be positioned within the switch body.

In an additional aspect, which may be combined with any other aspect herein, the cap may comprise at least one lug positioned and configured to selectively enter a corresponding channel in a corresponding weight of the plurality of weights.

In an additional aspect, which may be combined with any other aspect herein, a portion of the cap may be positioned within a channel of the stem.

In an additional aspect, which may be combined with any other aspect herein, each weight selector switch of the plurality of weight selector switches may comprise a split switch body, a first component of the split switch body having a portion thereof positioned within a channel of the stem, a second component of the split switch body coupled to the first component to lock the first component on the stem.

According to an additional aspect of the disclosure, a method of manufacturing a weight selecting device may comprise providing a stem, and mounting a plurality of weight selector switches to the stem, each weight selector switch of the plurality of weight selector switches positioned and configured to selectively couple a corresponding weight of the plurality of weights to the stem.

In an additional aspect, which may be combined with any other aspect herein, mounting each weight selector switch of the plurality of weight selector switches to the stem may further comprise positioning a sleeve onto the stem, positioning a switch body onto the sleeve, positioning a cap onto the switch body, and rotating the switch body and the cap to position a portion of the cap within a channel of the stem.

In an additional aspect, which may be combined with any other aspect herein, mounting each weight selector switch of the plurality of weight selector switches to the stem may further comprise positioning a portion of a first component within a channel of the stem, and coupling a second component to the first component.

According to a further aspect of the present disclosure, a weight selecting device may comprise a stem, and a plurality of weight selector switches mounted to the stem, each weight selector switch positioned and configured to selectively couple a corresponding weight of the plurality of weights to the stem.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
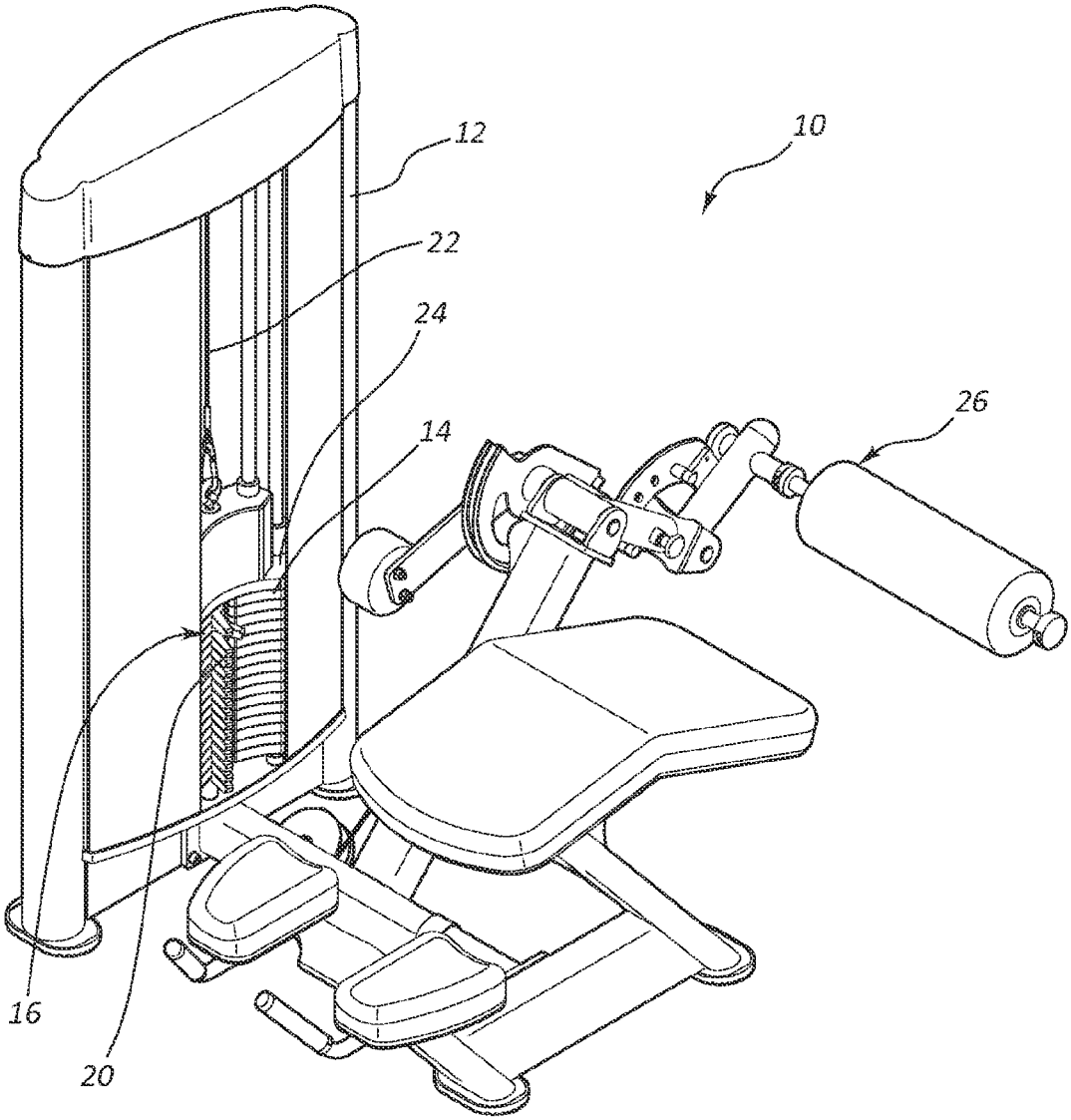
FIG. 1 is an isometric view of an exercise machine comprising a weight selector, according to an embodiment of the present disclosure.

As shown in FIG. 1, an exercise machine 10 may include a frame 12 and a plurality of weights 14 arranged in a stack within the frame 12. A weight selector assembly 16 may be positioned adjacent to the stacked weights 14 and may comprise a stem 18 (see FIG. 2), and a plurality of weight selector switches 20 mounted to the stem 18. A first end of a cable 22 may be coupled to the stem 18 via a carriage 24, and a second end of the cable 22 may extend to a component that may be actuated by a user, such as a leg bar 26, a hand bar, a handle, a lever, a cam, or other device which may be utilized by a user to exercise. In further embodiments, a mid-portion of a cable may be coupled to the stem 18, such as via a pulley (not shown).

Figure 4:
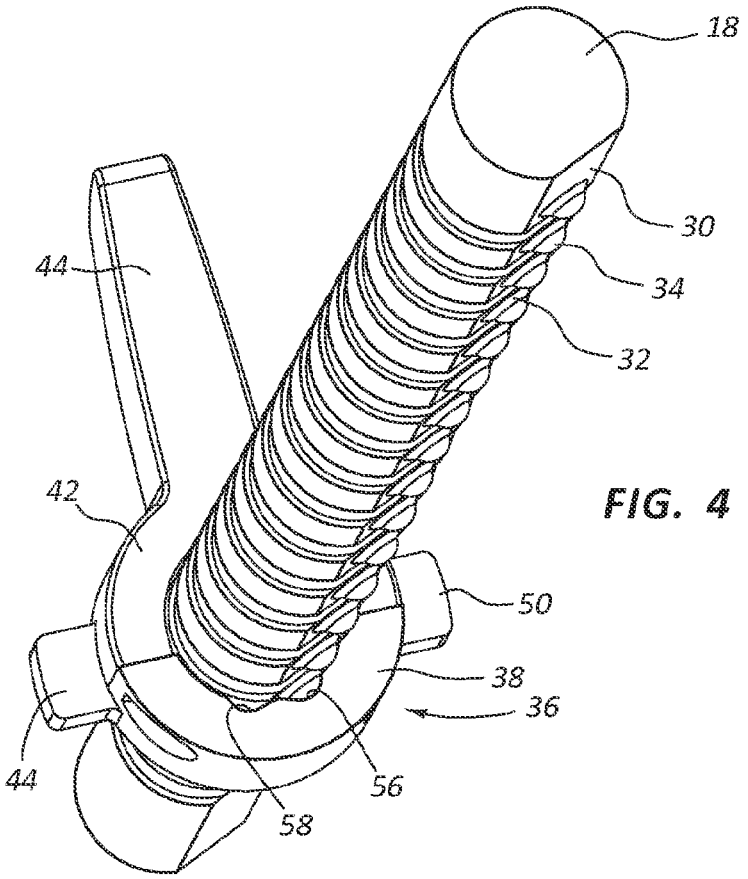
FIG. 4 is an isometric view from the top of a weight selector switch and stem of the weight selector assembly of FIG. 2, wherein the weight selector switch is positioned in the first position.
Figure 5:
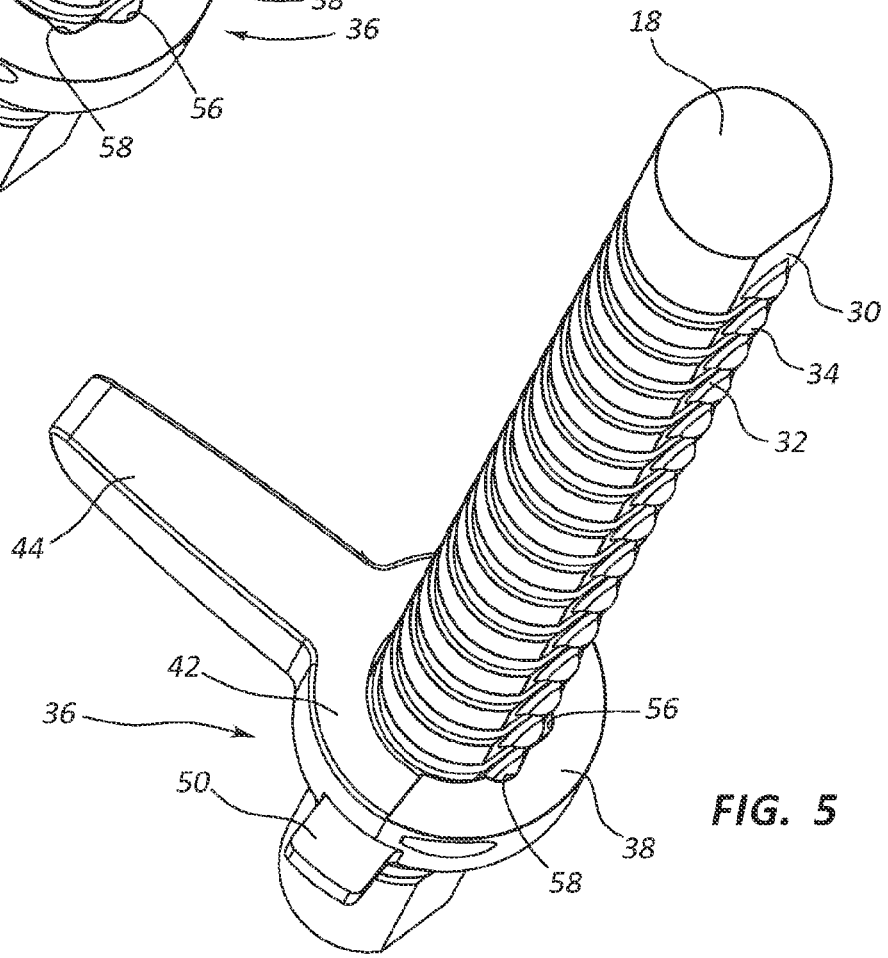
FIG. 5 is an isometric view from the top of the weight selector switch and stem of the weight selector assembly of FIG. 2, wherein the weight selector switch is positioned in a second position.

As shown in FIGS. 4 and 5, in some embodiments, the stem 18 of the weight selector assembly 16 may have a generally cylindrical elongate body having a plurality of channels 28 extending circumferentially thereabout. One side of the stem 18 may include a plurality of planar surfaces 30, and an aperture may extend through each of the planar surfaces 30. A cartridge 32 comprising spring biased ball 34 therein, a spring within the cartridge biasing the ball 34 outward toward an opening at one end of the cartridge 32, may be positioned within each aperture.

Figure 3:
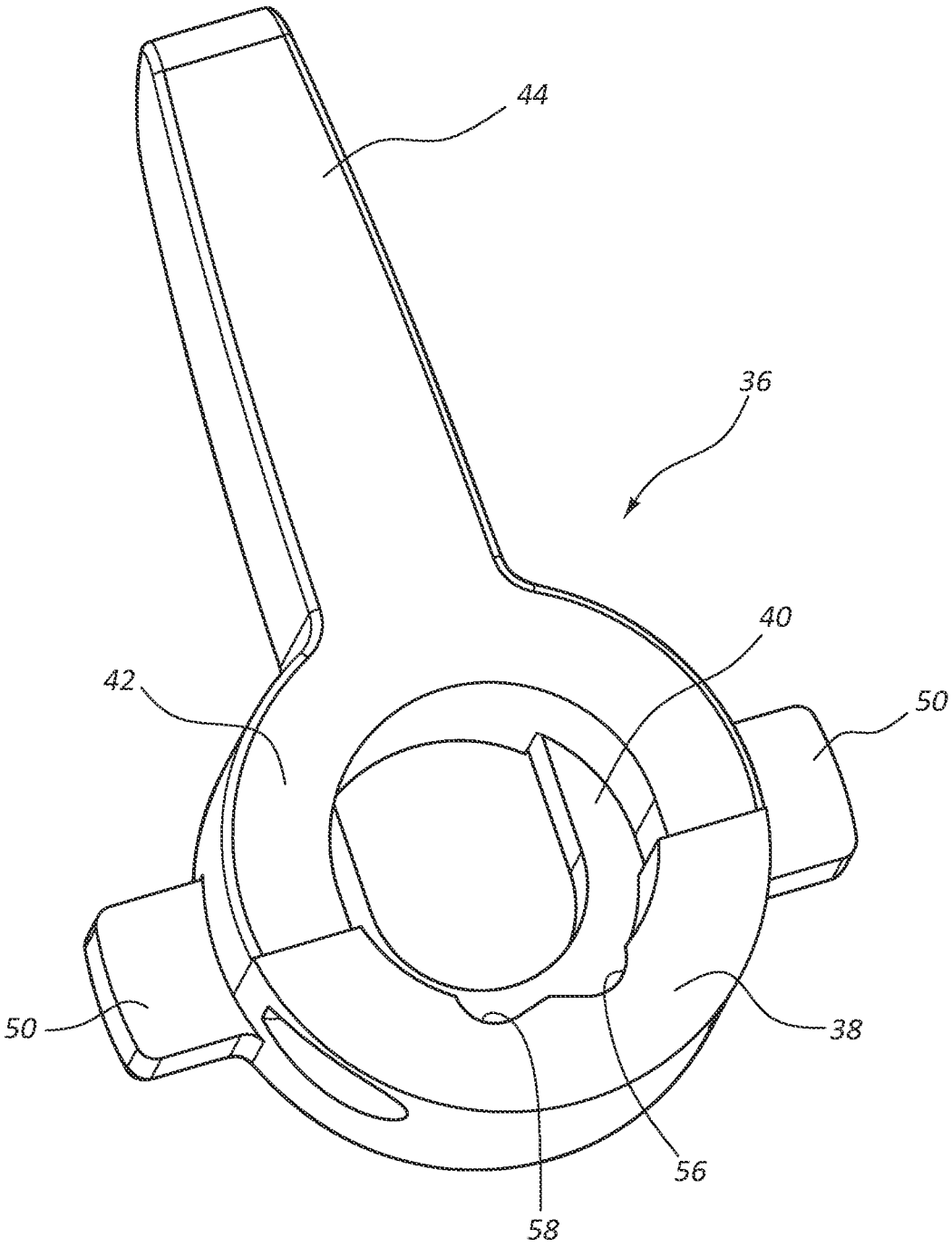
FIG. 3 is an isometric view from the top of a split switch body of the weight selector assembly of FIG. 2.

As shown in FIG. 3, each weight selector switch 20 may comprise a split switch body 36. A first component 38 of the split switch body 36 may include a portion 40 that is positioned within a channel 28 of the stem 18 to prevent longitudinal movement of the weight selector switch 20 relative to the stem 18. A second component 42 of the split switch body 36 may be coupled to the first component 38 to lock the first component 38 on the stem 18 and prevent lateral movement of the weight selector switch 20 relative to the stem 18. Additionally, the second component 42 may include a handle 44, sized and configured to facilitate the rotation of the split switch body 36 relative to the stem 18 by a user.

The first component 38 of the split switch body 36 may comprise threaded apertures and the second component 42 of the split switch body 36 may comprise corresponding through apertures. After the portion 40 of the first component 38 is positioned within a channel 28 of the stem 18 (see FIGS. 4 and 5), the through apertures of the second component 42 may be aligned with the threaded apertures of the first component 38 and screws may be installed therein.

The first component 38 may further comprise two laterally extending lugs 50. Each laterally extending lug 50 configured to selectively enter a corresponding opening 52 and channel 54 in a corresponding weight 14 upon rotation of the weight selector switch 20 relative to the stem 18 from a first position (see FIG. 2) to a second position (see FIG. 6). Accordingly, each weight selector switch 20 of the plurality of weight selector switches 20 may be positioned and configured to selectively couple a corresponding weight 14 in the stack of weights 14 to the stem 18.

Each weight selector switch 20 may include a detent mechanism that may facilitate positioning the respective weight selector switch 20 in each of the first and second positions. The split switch body 36 may include a first detent 56 and a second detent 58. For example, the first detent 56 and the second detent 58 may be formed in the first component 38 of the split switch body 36. Each of the first and second detents 56 and 58 may be positioned to align with a respective spring biased ball 34 located on the stem 18.

As shown in FIG. 4, when the weight selector switch 20 is positioned near the first position, the spring biased ball 34 may apply a torque to the split switch body 36 until the ball 34 comes to rest at the base of the first detent 56. Similarly, as shown in FIG. 5, when the weight selector switch 20 is positioned near the second position the spring biased ball 34 may apply a torque to the split switch body 36 until the ball 34 comes to rest at the base of the second detent 58.

Figure 2:
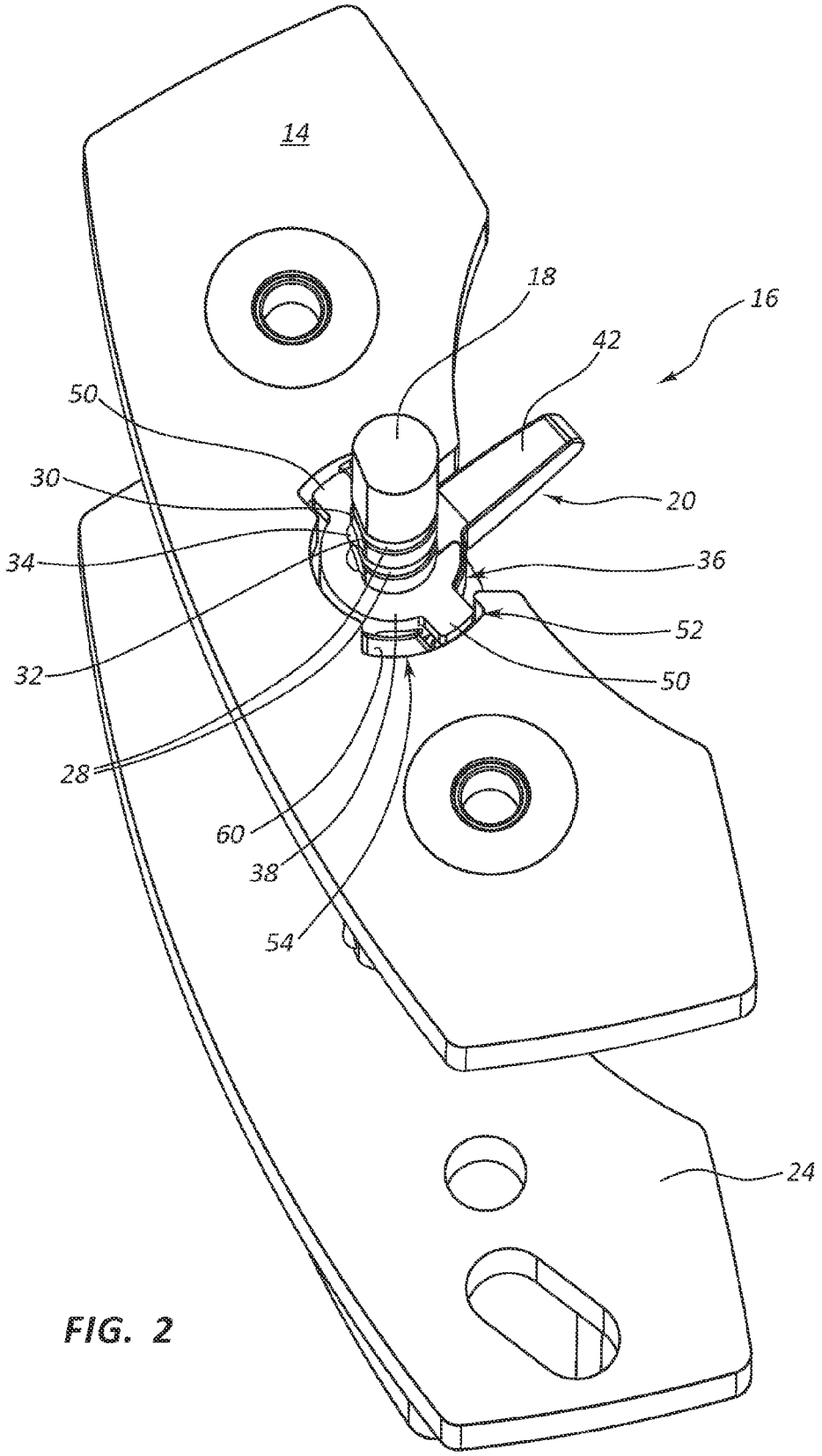
FIG. 2 is an isometric view from the bottom of a portion of a weight selector assembly having a detent mechanism including a spring biased balls located in a stem, according to an embodiment of the present disclosure, and wherein a weight selector switch is positioned in a first position.
Figure 6:
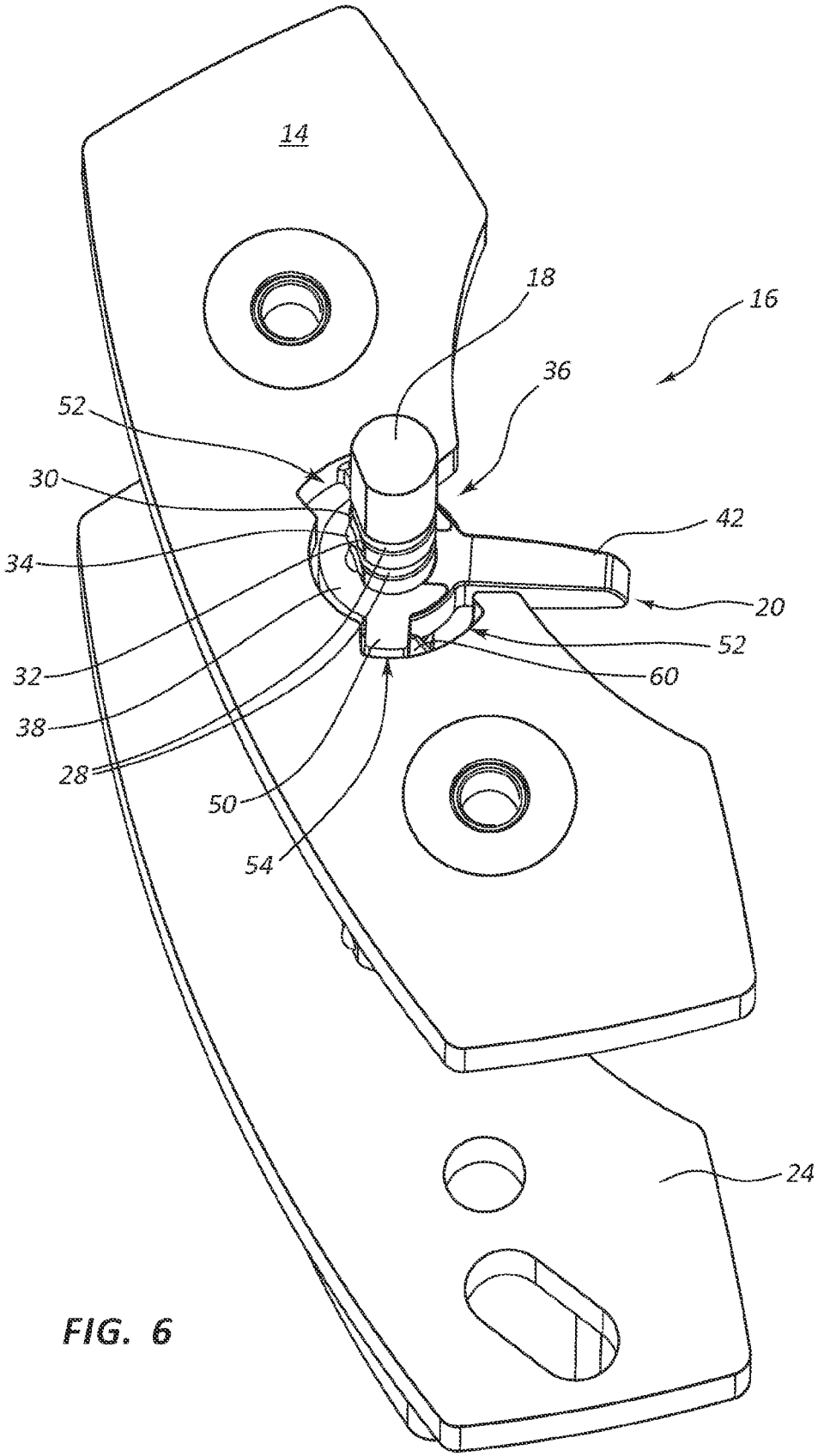
FIG. 6 is an isometric view from the bottom of the portion of a weight selector assembly of FIG. 2, wherein the weight selector switch is positioned in the second position.

As shown in FIGS. 2 and 6, each weight 14 may comprise an opening 52 corresponding to each lug 50 of the weight selector switch 20. When the respective weight selector switch 20 is positioned in a first position (see FIG. 2), each opening 52 may be positioned to facilitate the passage of a respective lug 50 of each weight selector switch 20 therethrough upon movement of the stem 18. Additionally, each weight 14 may comprise a channel 54 extending from each opening 52. The channel 54 may be positioned to receive a respective lug 50 of the weight selector switch 20 therein when the weight selector switch 20 is positioned in the second position (see FIG. 6). Accordingly, the channel 54, underlying an overhanging portion 60 of the weight 14, may facilitate a mechanical interference between the respective lug 50 and the overhanging portion 60 of the weight 14. This mechanical interference may cause the weight 14 to move with the stem 18 when the stem 18 is moved.

In manufacturing the weight selector assembly 16, the stem 18 may be machined from a cylindrical steel bar stock. The bar stock may be turned on a lathe to form the plurality of channels 28 and the bar stock may be milled to form the plurality of planar surfaces 30 and the apertures therein. After machining has been performed, the stem 18 may be hardened, such as by a heat treatment process.

The first component 38 of the split switch body 36 may be machined from a steel stock or from a casting. After machining has been performed, the first component 38 may be hardened, such as by a heat treatment process.

As the stem 18 and the first component 38 of the split switch body 36 may support the load of the weights 14, the material selected for the stem 18 and the first component 38 of the split switch body 36 should be selected to support the load of the weights 14. The second component 42 of the split switch body 36, however, may not carry the load of the weights 14. Accordingly, the second component 42 of the split switch body 36 may be formed of a material having a lower strength than the stem 18 and the first component 38 of the split switch body 36. This may allow the material of the second component 42 of the split switch body 36 to be selected to provide an aesthetically pleasing look and finish. In some embodiments, the second component 42 of the split switch body 36 may be manufactured from aluminum, or even a polymer.

The plurality of cartridges 32 comprising the spring biased balls 34 may then be inserted into the apertures in the stem 18. Each of the split switch bodies 36 may then be attached to the stem 18. The portion 40 of the first component 38 of each split switch body 36 may be inserted into a respective channel 28 of the stem 18. Then the second component 42 of each split switch body 36 may be positioned adjacent a corresponding first component 38 and fastened thereto.

The stem 18 may then be coupled to the carriage 24 and then positioned within the stack of weights 14 on an exercise machine 10. The carriage 24 may then be coupled to the cable 22 to provide a weight selector assembly 16 for the exercise machine 10.

Figure 7:
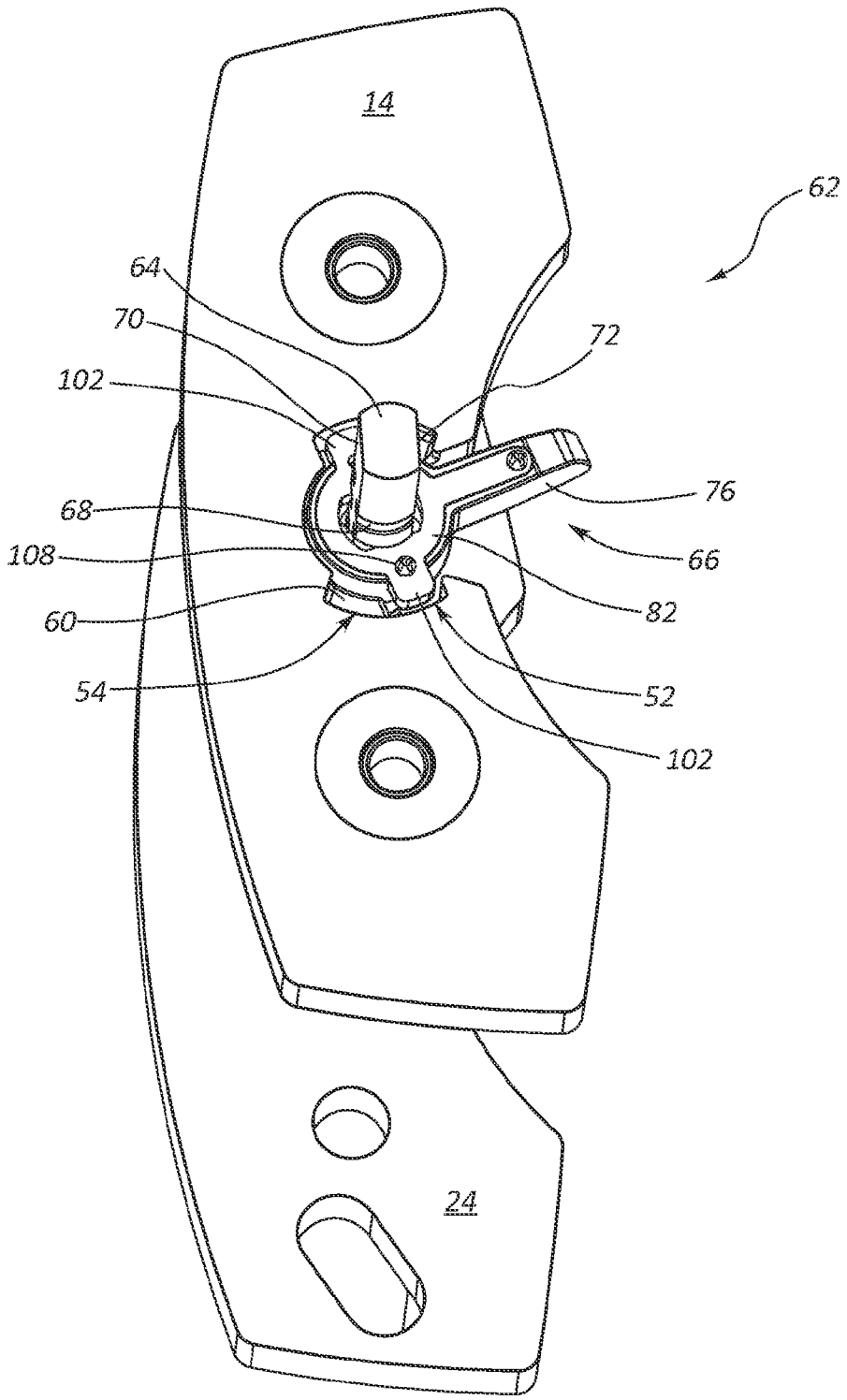
FIG. 7 is an isometric view from the bottom of a portion of a weight selector assembly having a detent mechanism including spring biased balls located in a weight selector switch, according to an embodiment of the present disclosure, and wherein the weight selector switch is positioned in a first position.

Referring now to FIG. 7, in further embodiments a weight selector assembly 62 may comprise a stem 64 that does not include apertures for cartridges comprising spring biased balls. Rather, each weight selector switch 66 may include a spring biased ball therein.

The stem 64 may comprise a generally cylindrical elongate body having a plurality of channels 68 extending circumferentially thereabout. A first side of the stem 64 may include a planar surface 70 formed therein, and an opposing second side of the stem may include a planar surface 72 formed therein.

Figure 8:
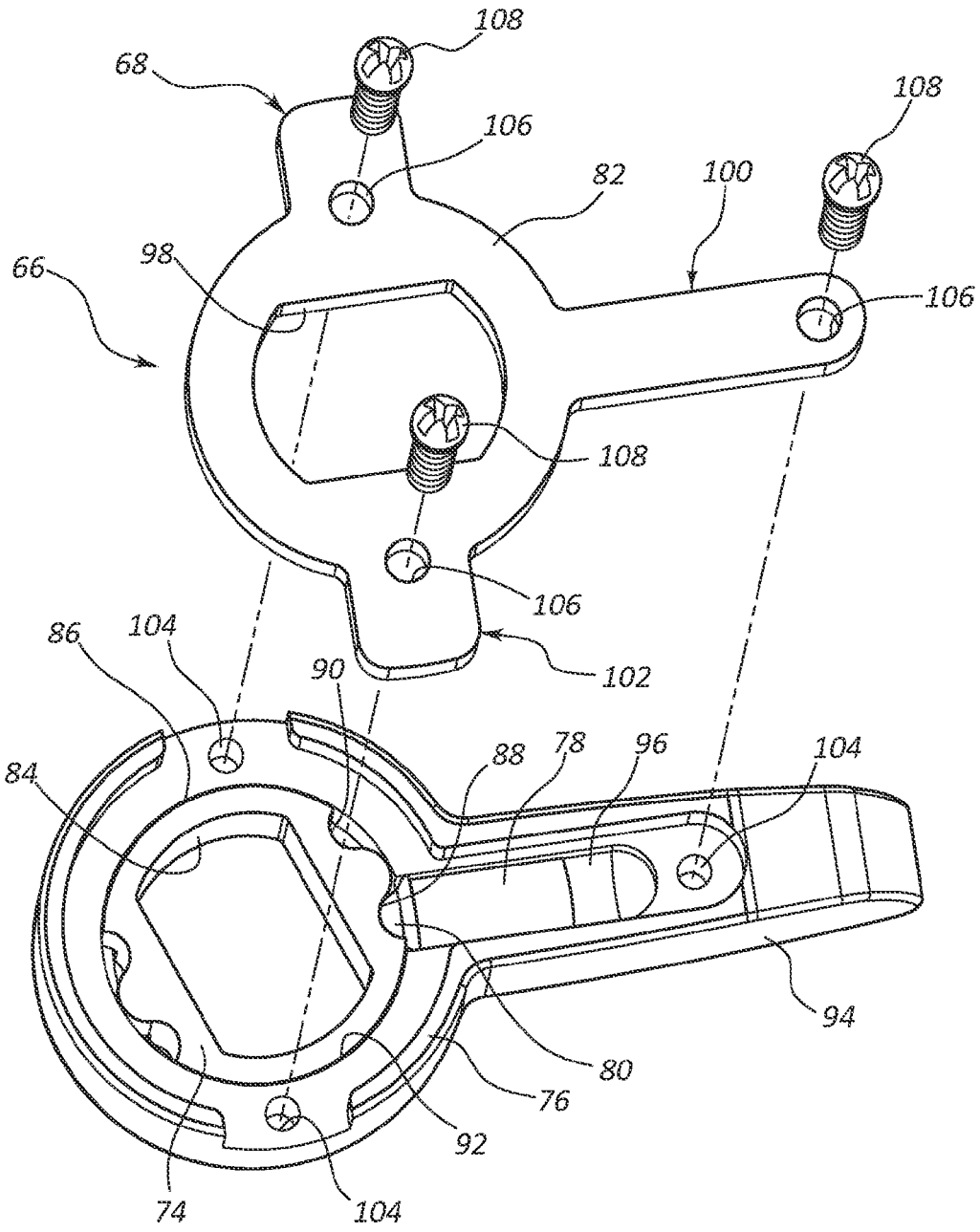
FIG. 8 is an isometric view from the bottom of the weight selector switch of the weight selector assembly of FIG. 7, showing a cap and retaining screws exploded from a switch body.

As shown in FIG. 8, each weight selector switch 66 may comprise a sleeve 74, a switch body 76, a cartridge 78 comprising a spring biased ball 80, and a cap 82. The sleeve 74 may include a central aperture 84 sized to correspond to the outer perimeter of the stem 64. The sleeve 74 may comprise an arcuate outer circumference 86 shaped generally as a side surface of a cylinder. First detents 88 and second detents 90 may be formed in the arcuate outer circumference 86. A set of first and second detents 88 and 90 may be formed on opposing sides of the sleeve 74, which may allow the sleeve 74 to be reversible. In some embodiments, however, a set of first and second detents 88 and 90 may be formed only in one side of the sleeve 74.

The switch body 76 may have an arcuate inner surface 92 sized to correspond to the arcuate outer circumference 86 of the sleeve 74. The switch body 76 may also include an extending handle 94 and a cavity 96 formed in the handle 94 sized to receive the cartridge 78 having the spring biased ball 80 therein.

The cap 82 may include a central aperture 98 sized to correspond to the outer perimeter of the stem 64 and an extending portion 100. The extending portion 100 may be sized to cover the cartridge 78 and the cavity 96 in the switch body 76. Additionally, the cap 82 may include two laterally extending lugs 102. Each laterally extending lug 102 may be configured to selectively enter a corresponding channel 28 in a corresponding weight 14 upon rotation relative to the stem 64 from a first position (see FIG. 7) to a second position (see FIG. 12). Accordingly, each weight selector switch 66 of the plurality of weight selector switches 66 may be positioned and configured to selectively couple a corresponding weight 14 to the stem 64.

The switch body 76 may include a plurality of threaded apertures 104 formed therein, and the cap 82 may include corresponding through apertures 106. Accordingly, when the cap 82 is positioned on the switch body 76, a screw 108 may be positioned through each through aperture 106 and threaded into a corresponding threaded aperture 104 to secure the cap 82 to the switch body 76.

Figure 9:
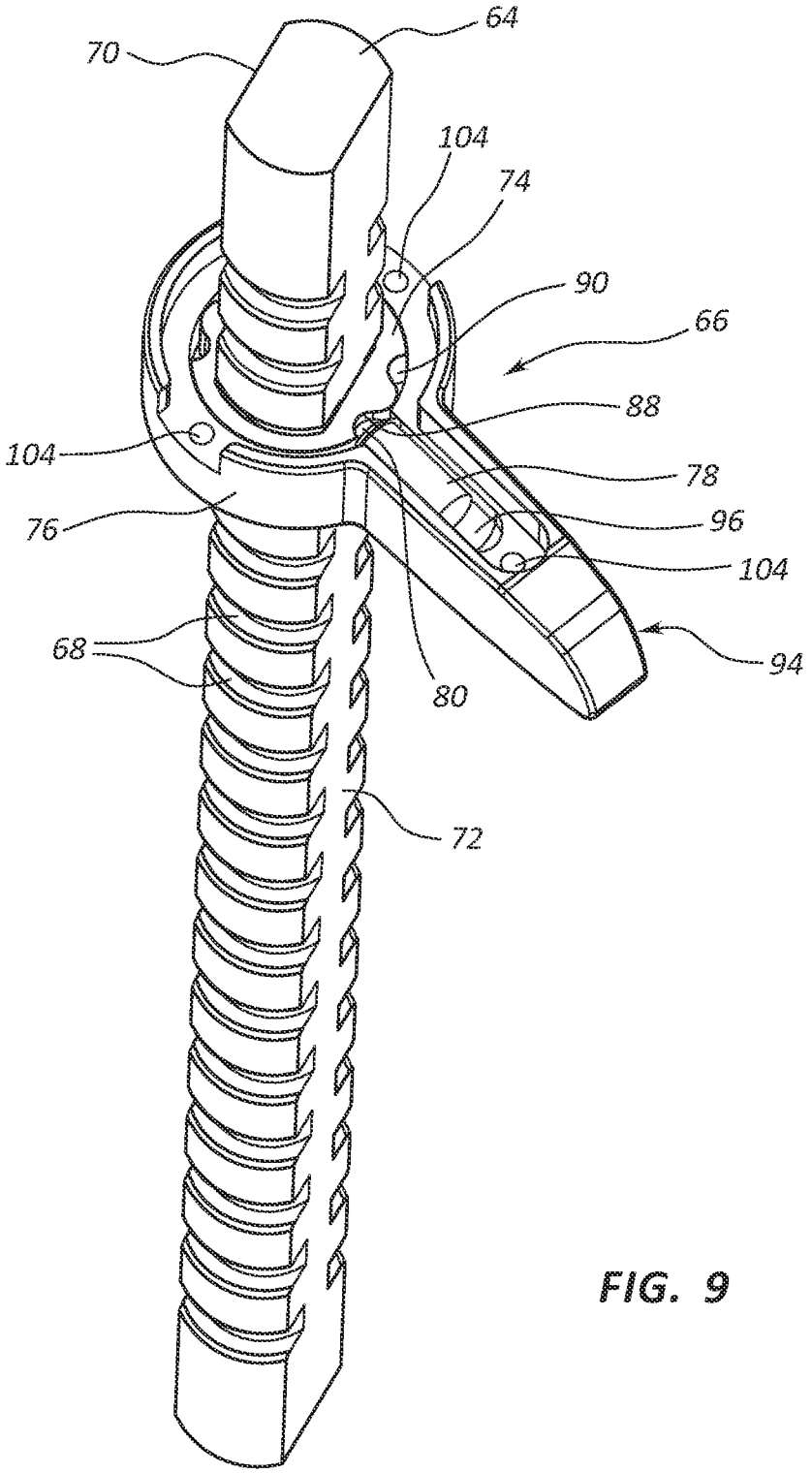
FIG. 9 is an isometric view from the bottom of a weight selector switch and stem of the weight selector assembly of FIG. 7, wherein the cap is removed and the switch body is positioned in the first position.
Figure 10:
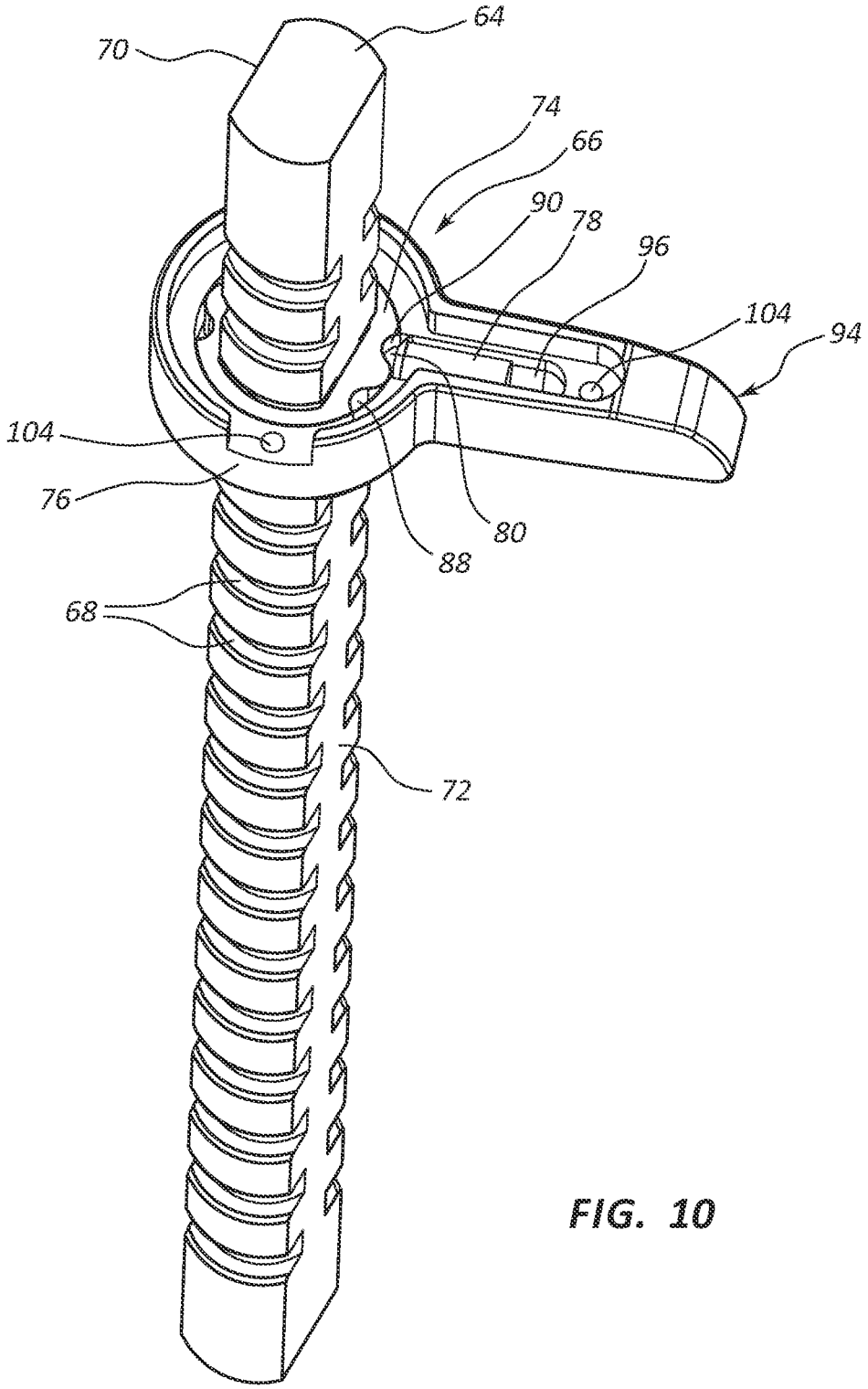
FIG. 10 is an isometric view from the bottom of a weight selector switch and stem of the weight selector assembly of FIG. 7, wherein the cap is removed and the switch body is positioned in a second position.

The spring biased ball 80 within each switch body 76 and first and second detents 88 and 90 within each sleeve 74 may provide a detent mechanism that may facilitate positioning the respective weight selector switch 66 in each of the first and second positions. As shown in FIG. 9, when the weight selector switch 66 is positioned near the first position the spring biased ball 80 may apply a torque to the switch body 76 until the ball 80 comes to rest at the base of a first detent 88. Similarly, as shown in FIG. 10, when the weight selector switch 66 is positioned near the second position the spring biased ball 80 may apply a torque to the switch body 76 until the ball 80 comes to rest at the base of a second detent 90.

When the weight selector switch 66 is installed on the stem 64, a portion of the cap 82 may be positioned within a channel 68 of the stem 64 to prevent longitudinal movement of the weight selector switch 66 relative to the stem 64. Additionally, the sleeve 74 may prevent lateral movement of the weight selector switch 66 relative to the stem 64. Additionally, the handle 94 of the switch body 76 may be sized and configured to facilitate the rotation of the switch body 76 and cap 82 relative to the stem 64 by a user.

Figure 12:
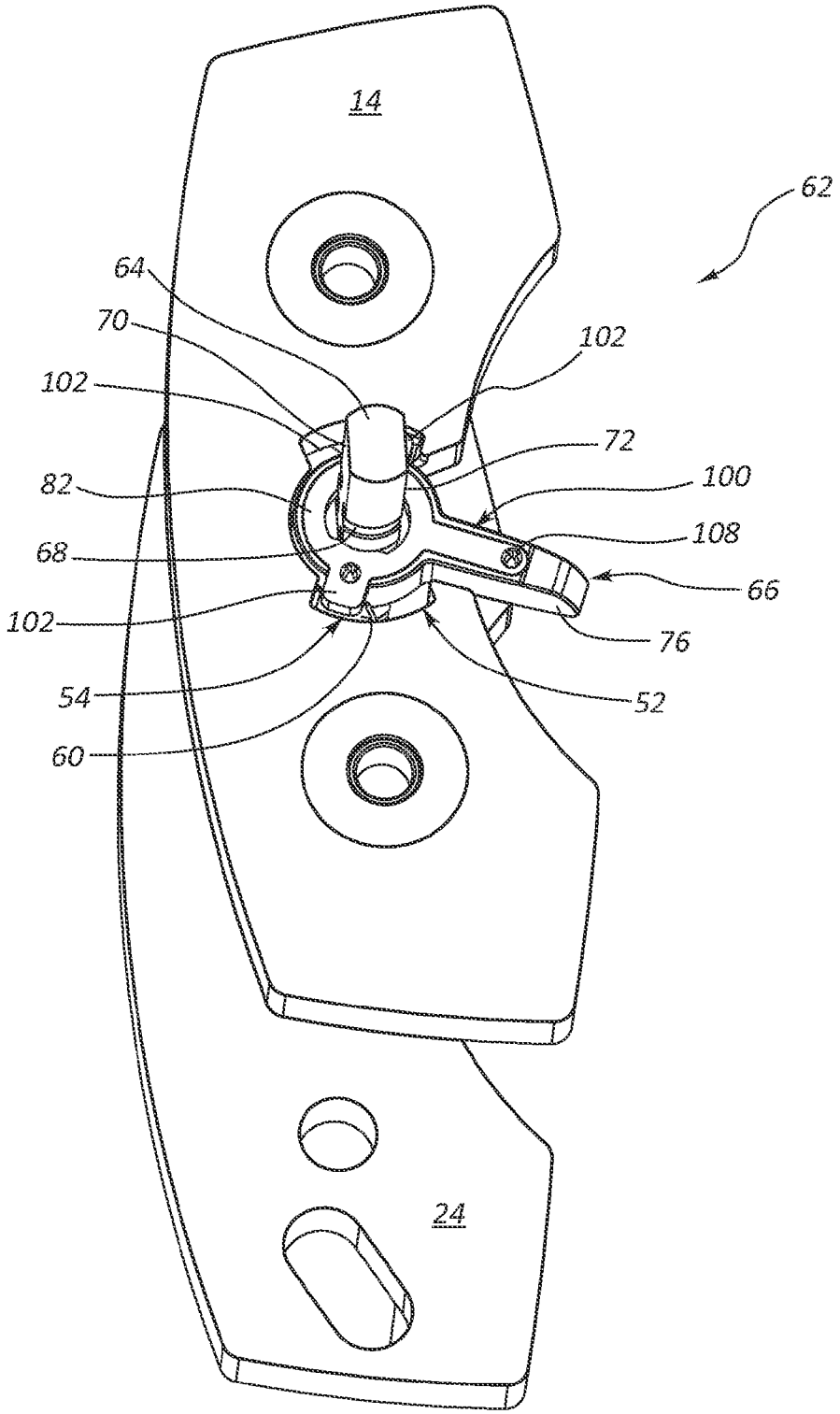
FIG. 12 is an isometric view from the bottom of the portion of the weight selector assembly of FIG. 7, wherein the weight selector switch is positioned in the second position.

As shown in FIGS. 7 and 12, each weight 14 may comprise an opening 52 corresponding to each lug 102 of the weight selector switch 66. When the respective selector switch 66 is positioned in a first position (see FIG. 7), each opening 52 may be positioned to facilitate the passage of a respective lug 102 of each weight selector switch 66 therethrough upon movement of the stem 64. Additionally, each weight 14 may comprise a channel 54 extending from each opening 52. The channel 54 may be positioned to receive a respective lug 102 of a weight selector switch 66 therein when the weight selector switch 66 is positioned in the second position (see FIG. 12). Accordingly, the channel 54, underlying the overhanging portion 60 of the weight 14, may facilitate a mechanical interference between the respective lug 102 and the overhanging portion 60 of the weight 14. This mechanical interference may cause the weight 14 to move with the stem 64 when the stem 64 is moved.

In manufacturing the weight selector assembly 66, the stem 64 may be machined from a cylindrical steel bar stock. The bar stock may be turned on a lathe to form the plurality of channels 68 and the bar stock may be milled on each side to form the planar surfaces 70 and 72. After machining has been performed, the stem 64 may be hardened, such as by a heat treatment process.

The sleeve 74 may be machined from a metal tube stock, such as a steel tube stock, and the cap 82 may be cut from a steel plate. After the cap 82 has been formed, the cap 82 may be hardened, such as by a heat treatment process.

As the stem 64 and the cap 82 may support the load of the weights 14, the material selected for the stem 64 and the cap 82 should be selected to support the load of the weights 14. The switch body 76, however, may not carry the load of the weights 14. Accordingly, the switch body 76 may be formed of a material having a lower strength than the stem 64 and the cap 82. This may allow the material of the switch body 76 to be selected to provide an aesthetically pleasing look and finish. In some embodiments, the switch body 76 may be manufactured from aluminum or even a polymer.

Referring now to FIG. 9, to assemble each weight selector switch 66, the sleeve 74 may be positioned on the stem 64. The cartridge 78 comprising the spring biased ball 80 may then be inserted into the cavity 96 in the switch body 76. The switch body 76 may then be positioned on the sleeve 74. When positioning the switch body 76 on the sleeve 74, the spring biased ball 80 may be aligned with a detent 88 or 90 in the sleeve 74 to reduce interference between the spring biased ball 80 and the sleeve 74.

Figure 11:
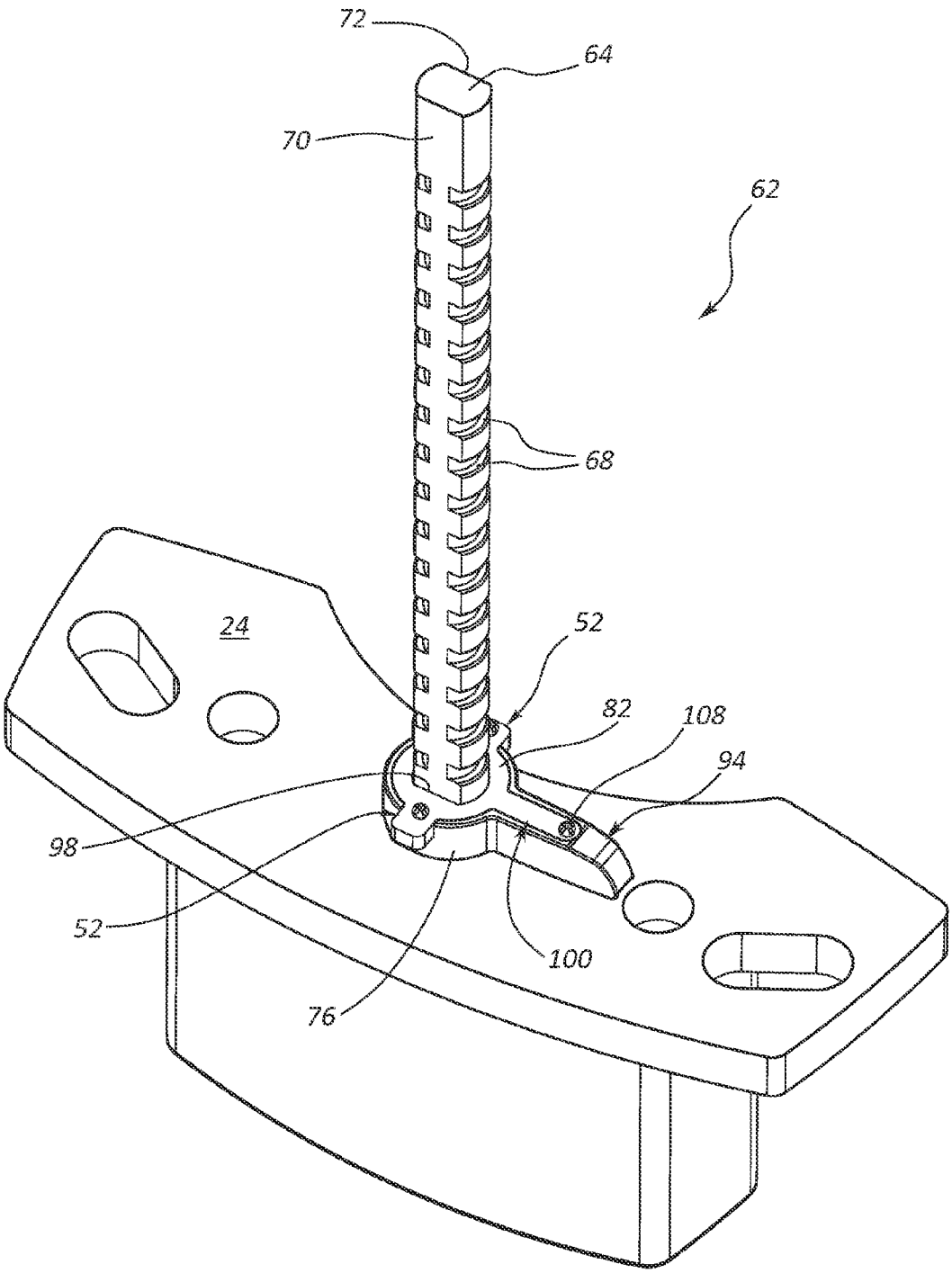
FIG. 11 is an isometric view from the bottom of a portion of the weight selector assembly of FIG. 7, wherein a weight selector switch is oriented for installation on, or removal from, the stem.

Referring now to FIG. 11, the switch body 76 may then be rotated so that the spring biased ball 80 is positioned between the two sets of first and second detents 88 and 90, such that the handle is oriented to be aligned with the planar surfaces 70 and 72 of the stem 64. The central aperture 98 of the cap 82 may then be aligned with the outer perimeter of the stem 64 and then positioned on the switch body 76. The cap 82 may then be fastened to the switch body 76 with the screws 108.

Referring now to FIG. 7, the weight selector switch 66 may then be rotated to the first position. Upon rotating the weight selector switch 66 to either the first position or the second position, a portion of the cap 82 may be positioned within a respective channel 68 of the stem 64 to couple the weight selector switch 66 to the stem 64 and prevent lateral movement of the weight selector switch 66 relative to the stem 64.

The stem 64 may be coupled to the carriage 24 and then positioned within the stack of weights 14 on the exercise machine 10. The carriage 24 may then be coupled to the cable 22 to provide the weight selector assembly 62 for the exercise machine 10.

In operation, a weight selector switch 20, 66 corresponding to a desired weight 14 may be operated by a user to select that weight 14. The user may rotate the weight selector switch 20, 66 relative to the stem 18, 64 from the first position to the second position. As a result the lugs 50, 102 of the weight selector switch 20, 66 may engage a corresponding weight 14 and the weight 14 may be coupled to the stem 18, 64. Accordingly, when the stem 18, 64 is moved by a user, the selected weight 14, any overlying weights 14, may move with the stem 18, 64 and provide a selected weight resistance while the user performs an exercise.

INDUSTRIAL APPLICABILITY

Exercise machines including a weight stack wherein an amount of weight applied to an attached cable may be selected by a user have been very popular. Such exercise machines may provide various selectable amounts of resistance, and thus may accommodate various exercises and various users with a single machine. There have been shortcomings, however, with conventional exercise machines that include a weight stack.

One problem with conventional exercise machines that include a weight stack lies in the way that weight is selected. Typically, a stem includes a plurality of apertures, each aperture corresponding to an aperture through a respective weight plate. To select a desired weight, a pin is inserted through an aperture of a weight plate and a corresponding aperture in the stem, thus coupling the weight plate to the stem. These pins may become lost, damaged, or stolen, which may render the machine unusable. Additionally, lost, damaged, or stolen pins may be replaced with a pin that is of insufficient strength or size.

Another difficulty is that the insertion and/or removal of a weight selector pin may be difficult for some users. For example, the apertures in the stem and weights may become misaligned, making it difficult to insert and/or remove the weight selector pin.

As shown in FIG. 1, an exercise machine may comprise a frame and a plurality of weights arranged in a stack within the frame. A weight selector assembly may be positioned adjacent to the stacked weights and may comprise a stem (see FIG. 2), and a plurality of weight selector switches mounted to the stem. A first end of a cable may be coupled to the stem via a carriage, and a second end of the cable may extend to a component that may be actuated by a user, such as a leg bar, a hand bar, a handle, a lever, a cam, or other device which may be utilized by a user to exercise. In further embodiments, a mid-portion of a cable may be coupled to the stem, such as via a pulley.

Each weight selector switch may be configured to easily select a desired weight to be utilized for an exercise. Accordingly, a precise and secure selection of weight may be easily and reliably achieved by a user. Additionally, the selection of the switch may provide ease of weight selection for users who may find it difficult to utilize conventional systems utilizing pins. Thus, the use of the exercise machine may be relatively easy, even for those with poor eye-hand coordination, those with poor eyesight, the elderly, and those with other disabilities.

As shown in FIGS. 4 and 5, in some embodiments, a weight selector assembly may include a stem comprising a generally cylindrical elongate body having a plurality of channels extending circumferentially thereabout. One side of the stem may include a plurality of planar surfaces, and an aperture may extend through each of the planar surfaces. A cartridge comprising a spring and a ball therein, the spring biasing the ball outward toward an opening at one end of the cartridge, may be positioned within each aperture.

As shown in FIG. 3, each weight selector switch may comprise a split switch body. A first component of the split switch body may include a portion that is positioned within a channel of the stem to prevent longitudinal movement of the weight selector switch relative to the stem. A second component of the split switch body may be coupled to the first component to lock the first component on the stem and prevent lateral movement of the weight selector switch relative to the stem. Additionally, the second component may include a handle, sized and configured to facilitate the rotation of the split switch body relative to the stem by a user.

As each of the weight selector switches may be physically coupled to the stem, there are no removable pieces that may be misplaced or lost.

The first component of the split switch body may comprise threaded apertures and the second component of the split switch body may comprise corresponding through apertures. After the portion of the first component is positioned within a channel of the stem (see FIGS. 4 and 5), the through apertures of the second component may be aligned with the threaded apertures of the first component and screws may be installed therein.

The first component may further comprise two laterally extending lugs. In further embodiments, however, a single lug may be utilized or more than two lugs may be utilized, and each weight may be configured to correspond to the lugs.

Each laterally extending lug may be configured to selectively enter a corresponding channel in a corresponding weight of the plurality of weights upon rotation relative to the stem from a first position (see FIG. 2) to a second position (see FIG. 6). Accordingly, each weight selector switch of the plurality of weight selector switches may be positioned and configured to selectively couple a corresponding weight of the plurality of weights to the stem.

By utilizing a plurality of lugs to engage a weight, a secure and robust connection may be provided. Additionally, the lugs may be more reliably aligned with the channels of a corresponding weight than a pin and aperture arrangement. Thus, the weight selectors may perform reliably without jamming or other difficulties associated with pin and aperture weight selection systems.

Each weight selector switch may include a detent mechanism that may facilitate positioning the respective weight selector switch in each of the first and second positions. The split switch body may include two detents. For example, the first component may include two detents. Each of the detents may be positioned to align with a respective spring biased ball located on the stem. As shown in FIG. 4, when the weight selector switch is positioned near the first position the spring biased ball may apply a torque to the split switch body until the ball comes to rest at the base of a first detent. Similarly, as shown in FIG. 5, when the weight selector switch is positioned near the second position the spring biased ball may apply a torque to the split switch body until the ball comes to rest at the base of a second detent.

Accordingly, the detent systems may facilitate a proper positioning of a respective weight selector switch in each of the first and second positions, making the weight selector switches reliable and easy to use.

As shown in FIGS. 2 and 6, each weight may comprise an opening corresponding to each lug of the weight selector switch. When the respective selector switch is positioned in a first position, each opening may be positioned to facilitate the passage of a respective lug of each weight selector switch therethrough upon movement of the stem. Additionally, each weight may comprise a channel extending from each opening. The channel may be positioned to receive a respective lug of a weight selector switch therein when the weight selector switch is positioned in the second position. Accordingly, the channel, underlying an overhanging portion of the weight, may facilitate a mechanical interference between the respective lug and the overhanging portion of the weight. This mechanical interference may cause the weight to move with the stem when the stem is moved.

In manufacturing the weight selector assembly, the stem may be machined from a cylindrical steel bar stock. In further embodiments, a metal or material other than steel may be utilized.

The bar stock may be turned on a lathe to form the plurality of channels and the bar stock may be milled to form the plurality of planar surfaces and the apertures therein. After machining has been performed, the stem may be hardened, such as by a heat treatment process.

The first component of the split switch body may be machined from a steel stock or from a casting. In further embodiments, a metal or material other than steel may be utilized.

After machining has been performed, the first component may be hardened, such as by a heat treatment process.

As the stem and the first component of the split switch body may support the selected weight of the weight stack, the material selected for the stem and the first component of the split switch body should be selected to support the weight of the weight stack. The second component of the split switch body, however, may not carry the load of the weight stack. Accordingly, the second component of the split switch body may be formed of a material having a lower strength than the stem and the first component of the split switch body. This may allow the material of the second component of the split switch body to be selected to provide an aesthetically pleasing look and finish. In some embodiments, the second component of the split switch body may be manufactured from aluminum or even a polymer.

The plurality of cartridges comprising spring biased balls may then be inserted into the apertures in the stem. Each of the split switch bodies may then be attached to the stem. The portion of the first component of each split switch body may be inserted into a respective channel of the stem. Then the second component of each split switch body may be positioned adjacent a corresponding first component and fastened thereto.

The stem may be coupled to a carriage and then positioned within a stack of weights on an exercise machine. The carriage may then be coupled to the cable to provide a weight selector assembly for the exercise machine.

Referring now to FIG. 7, in further embodiments a weight selector assembly may comprise a stem that does not include apertures for cartridges comprising spring biased balls. Rather, each weight selector switch may include a spring biased ball therein.

The stem may comprise a generally cylindrical elongate body having a plurality of channels extending circumferentially thereabout. A first side of the stem may include a planar surface formed therein, and an opposing second side of the stem may also include a planar surface formed therein.

As shown in FIG. 8, each weight selector switch may comprise a sleeve, a switch body, a cartridge comprising a spring biased ball, and a cap. The sleeve may include a central aperture sized to correspond to the outer perimeter of the stem. The sleeve may comprise an arcuate outer circumference shaped generally as a side surface of a cylinder. Detents may be formed in the arcuate outer circumference. A set of detents may be formed on opposing sides of the sleeve, which may allow the sleeve to be reversible. In some embodiments, however, a set of detents may be formed only in one side of the sleeve.

The switch body may have an inner surface sized to correspond to the arcuate outer circumference of the sleeve. The switch body may also include an extending handle and a cavity formed in the handle sized to receive a cartridge having a spring biased ball therein.

The cap may include a central aperture sized to correspond to the outer perimeter of the stem and an extending portion. The extending portion may be sized to cover the cartridge and the cavity in the switch body. Additionally, the cap may include two laterally extending lugs. In further embodiments, however, a single lug may be utilized or more than two lugs may be utilized, and each weight may be configured to correspond to the lugs.

Each laterally extending lug may be configured to selectively enter a corresponding channel in a corresponding weight of the plurality of weights upon rotation relative to the stem from a first position (see FIG. 7) to a second position (see FIG. 12). Accordingly, each weight selector switch of the plurality of weight selector switches may be positioned and configured to selectively couple a corresponding weight of the plurality of weights to the stem.

The switch body may include a plurality of threaded apertures formed therein, and the cap may include corresponding through holes. Accordingly, when the cap is positioned on the switch body, a screw may be positioned through each through hole and threaded into a corresponding threaded aperture to secure the cap to the switch body.

The spring biased ball within each switch body and detents within each sleeve may provide a detent mechanism that may facilitate positioning the respective weight selector switch in each of the first and second positions. As shown in FIG. 9, when the weight selector switch is positioned near the first position the spring biased ball may apply a torque to the switch body until the ball comes to rest at the base of a first detent. Similarly, as shown in FIG. 10, when the weight selector switch is positioned near the second position the spring biased ball may apply a torque to the switch body until the ball comes to rest at the base of a second detent.

When the weight selector switch is installed on the stem, a portion of the cap may be positioned within a channel of the stem to prevent longitudinal movement of the weight selector switch relative to the stem. Additionally, the sleeve may prevent lateral movement of the weight selector switch relative to the stem. Additionally, the handle of the switch body may be sized and configured to facilitate the rotation of the switch body and cap relative to the stem by a user.

As shown in FIGS. 7 and 12, each weight may comprise an opening corresponding to each lug of the weight selector switch. When the respective selector switch is positioned in a first position, each opening may be positioned to facilitate the passage of a respective lug of each weight selector switch therethrough upon movement of the stem. Additionally, each weight may comprise a channel extending from each opening. The channel may be positioned to receive a respective lug of a weight selector switch therein when the weight selector switch is positioned in the second position. Accordingly, the channel, underlying an overhanging portion of the weight, may facilitate a mechanical interference between the respective lug and the overhanging portion of the weight. This mechanical interference may cause the weight to move with the stem when the stem is moved.

In manufacturing the weight selector assembly, the stem may be machined from a cylindrical steel bar stock. In further embodiments, a metal or material other than steel may be utilized.

The bar stock may be turned on a lathe to form the plurality of channels and the bar stock may be milled on each side to form the planar surfaces. After machining has been performed, the stem may be hardened, such as by a heat treatment process.

The sleeve may be machined from a metal tube stock, such as a steel tube stock, and the cap may be cut from a steel plate. In further embodiments, a metal or material other than steel may be utilized for the cap. After the cap has been formed, the cap may be hardened, such as by a heat treatment process.

As the stem and the cap may support the selected weight of the weight stack, the material selected for the stem and the cap should be selected to support the weight of the weight stack. The switch body, however, may not carry the load of the weight stack. Accordingly, the switch body may be formed of a material having a lower strength than the stem and the cap. This may allow the material of the switch body to be selected to provide an aesthetically pleasing look and finish. In some embodiments, the switch body may be manufactured from aluminum or even a polymer.

Referring now to FIG. 9, to assemble each weight selector switch, the sleeve may be positioned on the stem. The cartridge comprising the spring biased ball may then be inserted into the cavity in the switch body. The switch body may then be positioned on the sleeve. When positioning the switch body on the sleeve, the spring biased ball may be aligned with a detent in the sleeve to reduce interference between the spring biased ball and the sleeve.

Referring now to FIG. 11, the switch body may then be rotated so that the spring biased ball is positioned between the two sets of detents and the handle is oriented to be aligned with the planar surfaces of the stem. The central aperture of the cap may then be aligned with the outer perimeter of the stem and then positioned on the switch body. The cap may then be fastened to the switch body with the screws.

Referring now to FIG. 7, the weight selector switch may then be rotated to the first position. Upon rotating the weight selector switch to either the first position or the second position, a portion of the cap may be positioned within a respective channel of the stem to couple the weight selector switch to the stem and prevent lateral movement of the weight selector switch relative to the stem.

The stem may be coupled to a carriage and then positioned within a stack of weights on an exercise machine. The carriage may then be coupled to the cable to provide the weight selector assembly for the exercise machine.

In operation, a weight selector switch corresponding to a desired weight may be operated by a user to select that weight. The user may rotate the weight selector switch relative to the stem from the first position to the second position. As a result the lugs of the weight selector switch may engage a corresponding weight and the weight may be coupled to the stem. Accordingly, when the stem is moved by a user, the selected weight, any overlying plates, may move with the stem and provide a selected weight resistance while the user performs an exercise.

What is claimed is:

1. An exercise machine, comprising:

a plurality of weights arranged in a stack;

a stem; and a plurality of weight selector switches mounted to the stem, each weight selector switch of the plurality of weight selector switches positioned and configured to selectively couple a corresponding weight of the plurality of weights to the stem;

wherein each weight selector switch of the plurality of weight selector switches includes a sleeve positioned on the stem, a switch body positioned on the sleeve, and a cap positioned on the switch body; and wherein the sleeve comprises at least two detents and a spring biased ball positioned within the switch body.

2. The exercise machine of claim 1, wherein each weight selector switch of the plurality of weight selector switches is rotatable relative to the stem.

3. The exercise machine of claim 1, wherein each weight selector switch of the plurality of weight selector switches comprises at least one lug positioned and configured to selectively enter a corresponding channel in a corresponding weight of the plurality of weights.

4. The exercise machine of claim 3, wherein each weight selector switch of the plurality of weight selector switches comprises two laterally extending lugs, each laterally extending lug configured to selectively enter a corresponding channel in a corresponding weight of the plurality of weights upon rotation relative to the stem.

5. The exercise machine of claim 1, wherein each weight selector switch of the plurality of weight selector switches comprises a respective detent mechanism.

6. The exercise machine of claim 5, wherein each of the respective detent mechanisms comprises a respective spring biased ball located within the stem.

7. The exercise machine of claim 5, wherein each of the respective detent mechanisms comprises a spring biased ball located within a respective weight selector switch.

8. The exercise machine of claim 1, wherein the stem comprises a plurality of channels and wherein a portion of each weight selector switch of the plurality of weight selector switches is positioned within a respective channel of the plurality of channels to couple each weight selector switch of the plurality of weight selector switches to the stem.

9. The exercise machine of claim 1, wherein each weight of the plurality of weights comprises at least one opening positioned to facilitate the passage of a respective lug of each weight selector switch of the plurality of weight selector switches therethrough as the stem is moved relative to the plurality of weights, and when the respective selector switch of the plurality of weight selector switches is positioned in a first position.

10. The exercise machine of claim 9, wherein each weight of the plurality of weights comprises a channel extending from each at least one opening, the channel positioned to receive a respective lug of each weight selector switch of the plurality of weight selector switches therein and facilitate mechanical interference between the respective lug and the weight causing the weight to move with the stem when the stem is moved, and when the respective selector switch of the plurality of weight selector switches is positioned in a second position.

11. The exercise machine of claim 1, wherein the stem is coupled to at least one cable.

12. The exercise machine of claim 1, wherein the cap comprises at least one lug positioned and configured to selectively enter a corresponding channel in a corresponding weight of the plurality of weights.

13. The exercise machine of claim 12, wherein a portion of the cap is positioned within a channel of the stem.

14. The exercise machine of claim 1, wherein each weight selector switch of the plurality of weight selector switches comprises a split switch body, a first component of the split switch body having a portion thereof positioned within a channel of the stem, a second component of the split switch body coupled to the first component to lock the first component on the stem.

15. A method of manufacturing a weight selecting device, the method comprising:

providing a stem;

mounting a plurality of weight selector switches to the stem, each weight selector switch of the plurality of weight selector switches positioned and configured to selectively couple a corresponding weight of the plurality of weights to the stem;

positioning a sleeve with at least two detents onto the stem;

positioning a switch body onto the sleeve;

positioning a cap onto the switch body;

positioning a spring biased ball within the switch body; and rotating the switch body and the cap to position a portion of the cap within a channel of the stem.

16. The method of claim 15, wherein mounting each weight selector switch of the plurality of weight selector switches to the stem further comprises:

positioning a portion of a first component within a channel of the stem; and coupling a second component to the first component.

17. A weight selecting device, comprising:

a stem; and a plurality of weight selector switches mounted to the stem, each weight selector switch positioned and configured to selectively couple a corresponding weight of the plurality of weights to the stem;

wherein each weight selector switch of the plurality of weight selector switches includes a sleeve positioned on the stem, a switch body positioned on the sleeve, and a cap positioned on the switch body; and wherein the sleeve includes at least two detents and a spring biased ball positioned within the switch body.

* * * * *